United States Patent [19]

Masuda et al.

[11] Patent Number: 4,930,467

[45] Date of Patent: Jun. 5, 1990

[54] INTERNAL COMBUSTION ENGINE WITH AUTOMATIC STARTER FOR PORTABLE WORKING MACHINE

[75] Inventors: Isao Masuda, Tachikawa; Giichi Iida, Tokyo, both of Japan

[73] Assignee: Kioritz Corporation, Tokyo, Japan

[21] Appl. No.: 277,902

[22] Filed: Nov. 23, 1988

[30] Foreign Application Priority Data

Nov. 25, 1987 [JP] Japan ..... 62-179213[U]

[51] Int. Cl.[5] ..... F02N 17/00

[52] U.S. Cl. ..... 123/179 P; 123/179 D

[58] Field of Search ..... 123/179 D, 179 P, 179 SE, 123/149 D, 149 A, 185 BA; 74/625; 290/47

[56] References Cited

U.S. PATENT DOCUMENTS

| | | | |
|---|---|---|---|
| 1,211,072 | 1/1917 | Brush | 290/47 |
| 1,990,306 | 2/1935 | Nardone | 123/179 D |
| 2,508,833 | 5/1950 | Metsger | 74/625 |
| 2,865,358 | 12/1958 | Musgrave | 123/179 SE |
| 2,939,448 | 6/1960 | Hansen | 123/179 P |
| 3,219,021 | 11/1965 | Mercer et al. | 123/179 P |
| 3,723,809 | 3/1973 | Fujii | 123/149 A |
| 3,747,649 | 7/1973 | Denslow et al. | 123/185 BA |
| 3,774,303 | 11/1973 | Burkett et al. . | |
| 4,160,435 | 7/1979 | Sleder | 123/149 D |
| 4,582,030 | 4/1986 | Reese | 123/185 BA |

FOREIGN PATENT DOCUMENTS 63-79471 5/1988 Japan .

*Primary Examiner*—Willis R. Wolfe
*Assistant Examiner*—M. Macy

[57] ABSTRACT

An internal combustion engine with an automatic starter for a portable working machine, wherein a reduction device is arranged at an end portion opposite to an output end of a crankshaft of the internal combustion engine, a generator being arranged at a side near the reduction device, the automatic starter being arranged in the proximity of a side portion of the internal combustion engine and being drivingly connected to the reduction device, a recoil-type starter being arranged coaxially with and adjacent to the end portion of the crankshaft.

3 Claims, 1 Drawing Sheet

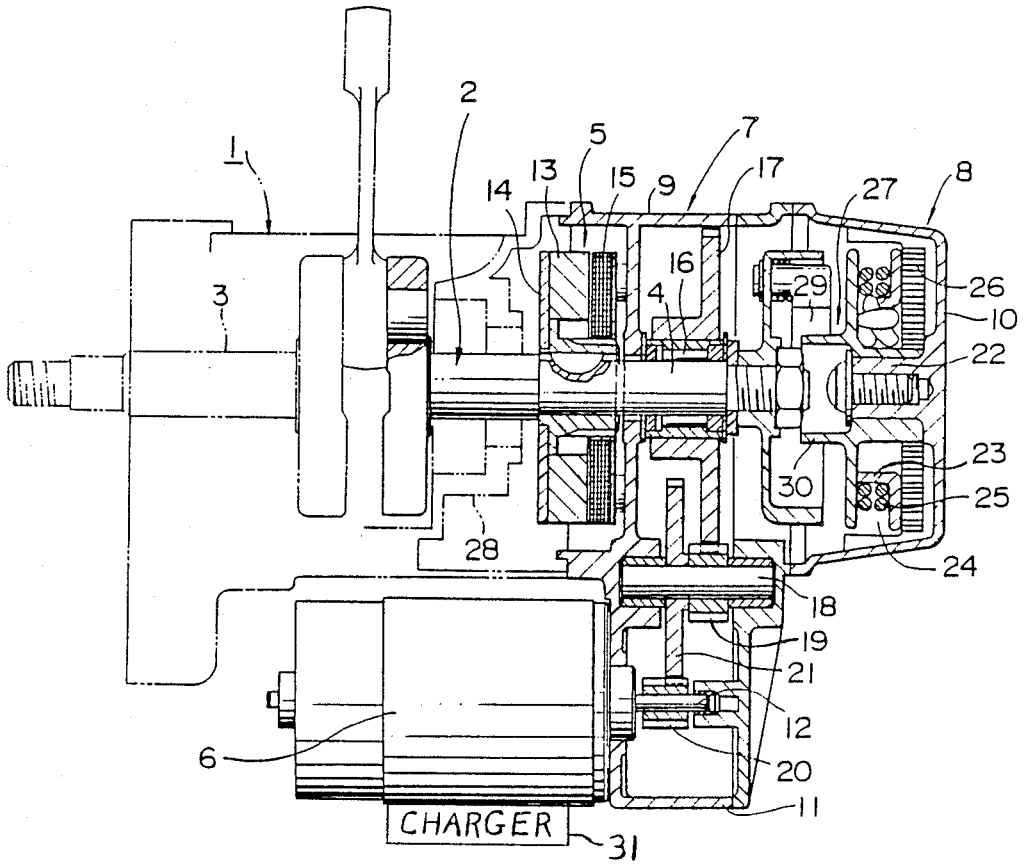
1
2
3
4
5
6
7
8
9
10
11
12
13
14
15
16
17
18
19
20
21
22
23
24
25
26
27
28
29
30
31
CHARGER

INTERNAL COMBUSTION ENGINE WITH AUTOMATIC STARTER FOR PORTABLE WORKING MACHINE

BACKGROUND OF THE INVENTION

This invention relates to an internal combustion engine including an automatic starter for use with a portable working machine.

It is important that, portable working machines such as bush cutters, chain saws, backpack-type dust collectors and the like are so constructed as to be compact and light. Conventional internal combustion engines for portable working machines were provided with recoil-type starters as starting systems for actuating the engines. Recently, a starting system including both the recoil-type starter and an automatic starter to facilitate the starting operation of the starting system has been manufactured. However, a conventional starting system including both the recoil-type starter and the automatic starter was large-sized and complicated and was unsuitable to adopt to portable working machines. Further, in the conventional starting system, there was a problem that the assembling and maintenance of the starting system was very difficult and troublesome.

SUMMARY OF THE INVENTION

Accordingly, an object of the present invention is to provide an internal combustion engine with an automatic starter for a portable working machine, wherein a recoil-type starter, an automatic starter and a charging generator are provided for facilitating the starting operation of the engine, these starters and generator are arranged in compact fashion to facilitate the assembling, maintenance and/or inspection of the engine, and which can eliminate the above-mentioned drawback of the conventional engine.

According to the present invention, an internal combustion engine with an automatic starter for a portable working machine comprises an internal combustion engine, a generator, an automatic starter, a reduction device for connecting the automatic starter to a crankshaft of the internal combustion engine, and a recoil-type starter, and is characterized in that the reduction device is arranged at an end portion opposite to an output end of the crankshaft of the internal combustion engine: the generator is arranged at a side near the reduction device; the automatic starter is arranged in the proximity of a side of the internal combustion engine and is drivingly connected to the reduction device; and the recoil-type starter is arranged coaxially with and adjacent the end of the crankshaft. Accordingly, since the generator, automatic starter, reduction device and recoil-type starter are arranged altogether at the axial end opposite to the output end of the crankshaft of the internal combustion engine, electric power is adequately supplied to a battery and the like by the generator, the generator, automatic starter, reduction device and recoil-type starter can be assembled in compact fashion to facilitate the maintenance and/or inspection thereof, and the generator can be easily arranged without alternation of the configuration of a crankcase.

BRIEF DESCRIPTION OF THE DRAWING

An attached Figure is a longitudinal sectional view showing a main part of an internal combustion engine with an automatic starter for a portable working machine according to a preferred embodiment of the present invention.

PREFERRED EMBODIMENT OF THE INVENTION

The present invention will now be explained in connection with an embodiment shown in the drawing.

An illustrated embodiment shows an example of an internal combustion engine adapted to be used with, for example, a bush cutter and the like. In the illustrated embodiment, a crankshaft 2 of an internal combustion engine 1 is arranged to extend in a horizontal direction. One end, i.e., an output end 3 of the crankshaft 2 is connected to a cutter blade (not shown) of the working machine through a centrifugal clutch (not shown) so that when the engine 1 is activated to rotate the crankshaft 2, the cutter blade is driven to perform a desired work. On the other end portion 4 of the crankshaft 2, a generator 5, a reduction device 7 drivingly connected to an automatic starter 6 and a recoil-type starter 8 are mounted in order toward the outside, as will be explained hereinafter. The generator 5 and the reduction device 7 are arranged within a reducer case 9 fixed to a crankcase 28 of the engine 1 and protruding axially from the crankcase 28. The recoil-type starter 8 includes a starter case 10 fixed to the free end of the reducer case 9. In the illustrated embodiment, the automatic starter 6 is an electric motor, which is arranged below and adjacent the engine 1, one end of the motor being fixed to a side face of a lower extension 11 of the reducer case 9. A motor shaft 12 of the automatic starter 6 is rotatably supported and extends into the reducer case 9 in parallel with and in the same direction as the other end portion 4 of the crankshaft 2.

The generator 5 includes a rotor 14 keyed to the crankshaft 2 and having magnets 13 fixedly mounted thereon, and stator windings 15 fixed to the reducer case 9 and arranged in confronting relation to the magnets 13 of the rotor 14. When the crankshaft 2 is rotated, the magnets 13 are rotated with respect to the stator windings 15 to generate electric current in the windings. The generated electric current can be supplied to a charger 31 for the automatic starter, illuminating lamps and the like, shown in block form as mounted on automatic starter 6, but which could as well be installed within its casing.

The reduction device 7 includes a first large gear 17 attached to the crankshaft 2 through a one-way clutch 16, an intermediate shaft 18 rotatably supported by the reducer case 9 and extending in parallel with the crankshaft 2 below the latter, a first pinion 19 fixed to the intermediate shaft 18 and meshed with the first large gear 17, and a second large gear 21 fixed to the intermediate shaft 18 and meshed with a second pinion 20 fixed to the motor shaft 12 of the automatic starter 6. When the engine 1 is started by means of the automatic starter 6, the driving power from the motor shaft 12 of the automatic starter 6 is reduced and transmitted, through the second pinion 20, second large gear 21, first pinion 19, first large gear 17 and one-way clutch 16, to the crankshaft 2 to rotate this crankshaft, thereby starting the engine 1. In this case, the recoil-type starter 8 is disconnected from the crankshaft 2 by means of a ratchet device which will be explained later, and remains stationary.

The recoil-type starter 8 includes the above-mentioned starter case 10 fixed to the free end of the reducer case 9 coaxially with the crankshaft 2. The recoil-type starter 8 further comprises a boss portion 22 formed on the starter case 10 and arranged adjacent to the other end portion 4 of the crankshaft 2, a recoil drum 23 rotatably supported by the boss portion 22, a recoil rope 25 wound around and positioned into a circumferential groove 24 of the recoil drum 23 and having a free end extending outside the starter case 10, a recoil spring 26 for winding up the recoil rope 25 onto the recoil drum 23, and a centrifugal ratchet device 27 connected between the recoil drum 23 and the other end portion 4 of the crankshaft 2 to transmit rotational force (acting in a direction for starting the engine) of the recoil drum 23 to the crankshaft 2. When the engine 1 is started by means of the recoil-type starter 8, an operator pulls the recoil rope 25 outside the starter case 10 against the action of the spring 26, thereby rotating the recoil drum 23. The rotational force of the recoil drum 23 is transmitted to the crankshaft 2 through the ratchet device 27, thereby rotating the crankshaft 2, thus starting the engine 1. When the number of revolutions of the crankshaft 2 is increased, a ratchet pawl 29 of the ratchet device 27 is automatically disengaged from an engagement portion 30 of the recoil drum 23 under the action of centrifugal force exerted on the pawl 29. In this case, the reduction device 7 cannot rotate due to the presence of the one-way clutch 16, and thus remains stationary.

What is claimed is:

1. An internal combustion engine with an automatic starter comprising the internal combustion engine having a crankshaft;

a generator having stator windings, a rotor fixed to said crankshaft, magnets fixed mounted on said rotor;

a reduction device connecting said automatic starter to said crankshaft;

charger means to operate said automatic starter connected to receive electric power from said stator windings of said generator;

and a recoil-type starter arranged coaxially with and adjacent to said crankshaft for rotation of said rotor through rotation of said crankshaft.

2. An internal combustion engine with an automatic starter for a portable working machine, comprising an internal combustion engine, a generator, an automatic starter, a reduction device for connecting said automatic starter to a crankshaft of said internal combustion engine and a recoil-type starter, wherein:

said reduction device is arranged at an end portion opposite an output end of said crankshaft of said internal combustion engine;

said generator is arranged at a side near said reduction device;

said automatic starter is arranged in the proximity of a side portion of said internal combustion engine and is drivingly connected to said reduction device;

said recoil-type starter is arranged coaxially with and adjacent to said end portion of said crankshaft for operation of said generator through said crankshaft;

and said generator includes a rotor fixed to said crankshaft, magnets fixedly mounted on said rotor, stator windings fixed to a case of said reduction device and arranged in confronting relation to said magnets of said rotor;

an electric power source from electric current generated in said stator windings as said magnets are rotated together with said crankshaft;

a charger for said automatic starter supplied by said electric power source and supplying power to said automatic starter whereby said internal combustion engine is started by said automatic starter operated by said electric power source through said charger.

3. The internal combustion engine with an automatic starter in claim 2, wherein said electric power source is also used for the illumination of lamps.

* * * * *